United States Patent [19]

Roberts et al.

[11] 4,055,002

[45] Oct. 25, 1977

[54] PORTABLE FOOTBALL DRYER

[76] Inventors: David M. Roberts, 1713 Robinhood Lane; James A. Sever, 918 University Drive, both of Clearwater, Fla. 33516

[21] Appl. No.: 693,674

[22] Filed: June 7, 1976

[51] Int. Cl.[2] ..... F26B 25/00

[52] U.S. Cl. ..... 34/104; 34/95; 34/202

[58] Field of Search ..... 34/103, 104, 100, 77, 34/69–71, 95, 202

[56] References Cited

U.S. PATENT DOCUMENTS

| | | | |
|---|---|---|---|
| 2,315,246 | 3/1943 | Cunning | 34/95 |
| 2,527,745 | 10/1950 | Lawrence | 34/100 |
| 3,012,334 | 12/1961 | Davis, Jr. | 34/104 |
| 3,747,226 | 7/1973 | Graffius | 34/104 |

*Primary Examiner*—Kenneth W. Sprague
*Assistant Examiner*—James C. Yeung
*Attorney, Agent, or Firm*—Caesar, Rivise, Bernstein & Cohen, Ltd.

[57] ABSTRACT

Portable apparatus for drying wet footballs. The apparatus comprises a housing supported on wheels and including a drying chamber for receipt of a wet football therein. The drying chamber includes a pair of concave contoured moisture absorbent rollers. The rollers are disposed parallel to one another and spaced apart by sufficient distance that a football can be placed within the space between the rollers and supported thereon. A motor is coupled through pulley means to effect the rotation of the rollers in the same direction but at different speeds. The frictional engagement between one of the rollers and the ball causes the ball to rotate at a different speed than the speed of rotation of the other rollers to effect the rubbing action between the ball and the other roller thereby wiping the surface of the ball. A spring biased hold down roller is provided to hold the ball in place during the rotation thereof by the first and second rollers. Ball ejection means are provided for removing the ball from the rotating rollers. A blower is provided to blow air across the ball as it is rotated. The housing is closed and the air therein recirculated through dessicating means and back to the roller for reuse. A sealed beam lamp is disposed over the space between the rollers so as to provide gentle heat for effecting the heating of the ball as it is being rotated to thereby further effectuate drying of the ball. Power is provided to the blower and the motor by a battery mounted within the housing.

12 Claims, 5 Drawing Figures

FIG. 1
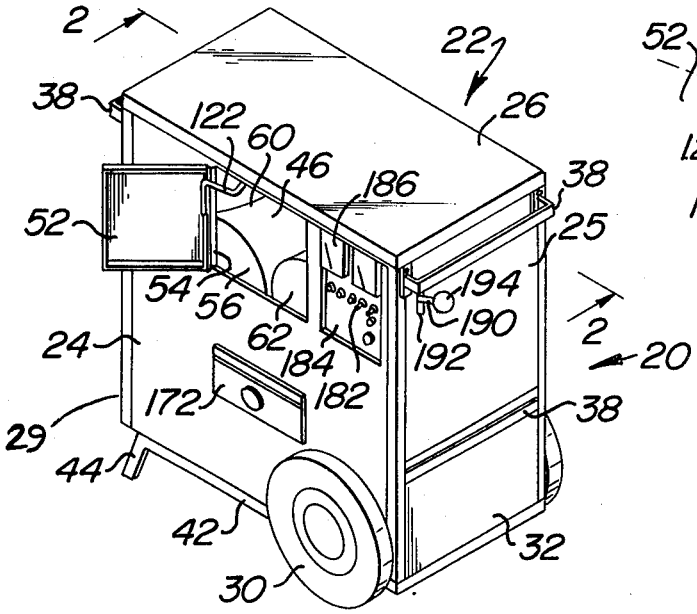
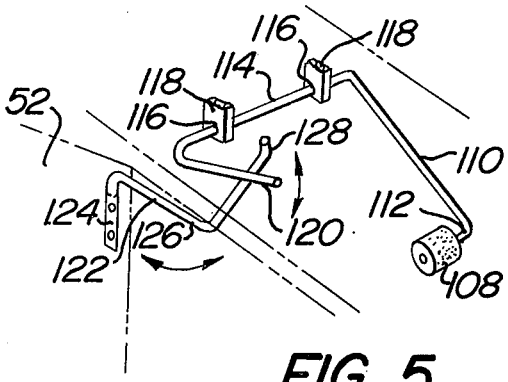
FIG. 5
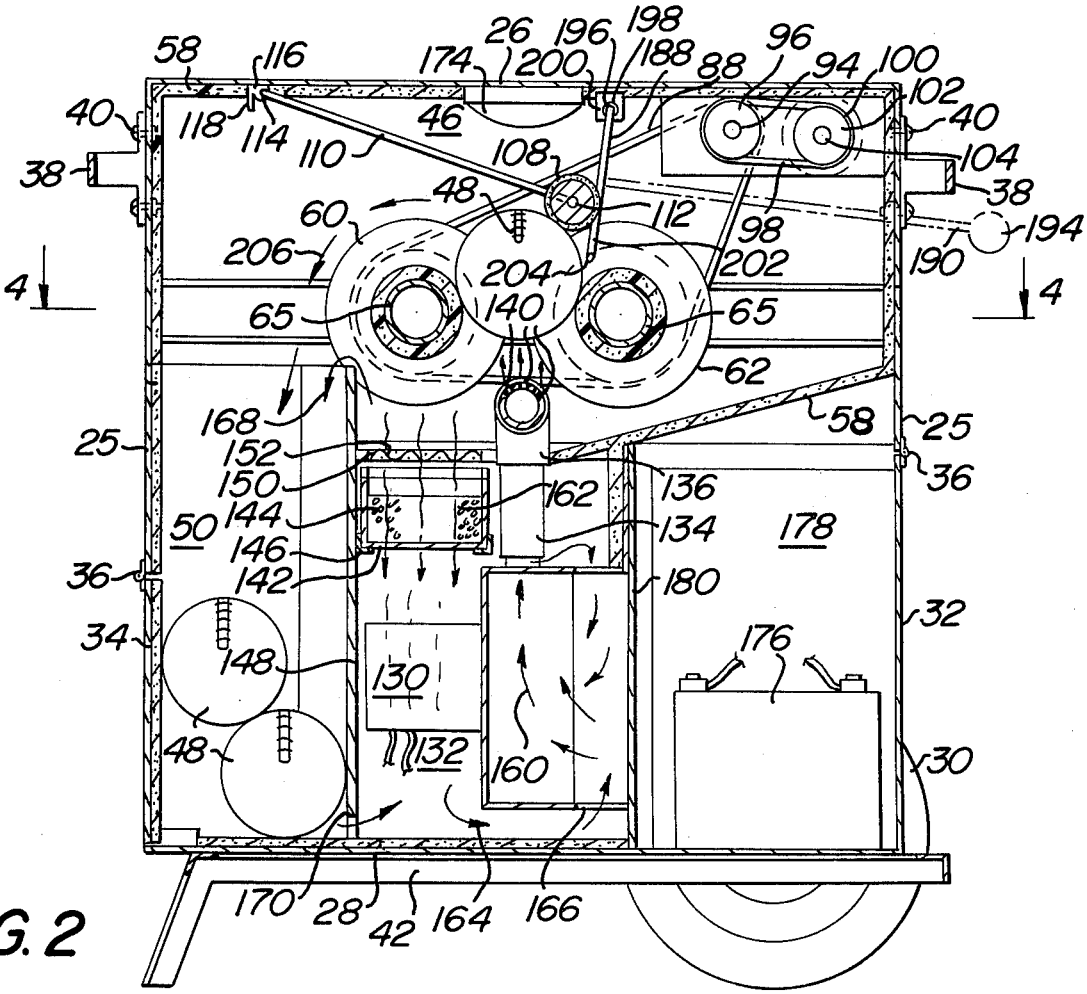
FIG. 2

FIG. 3
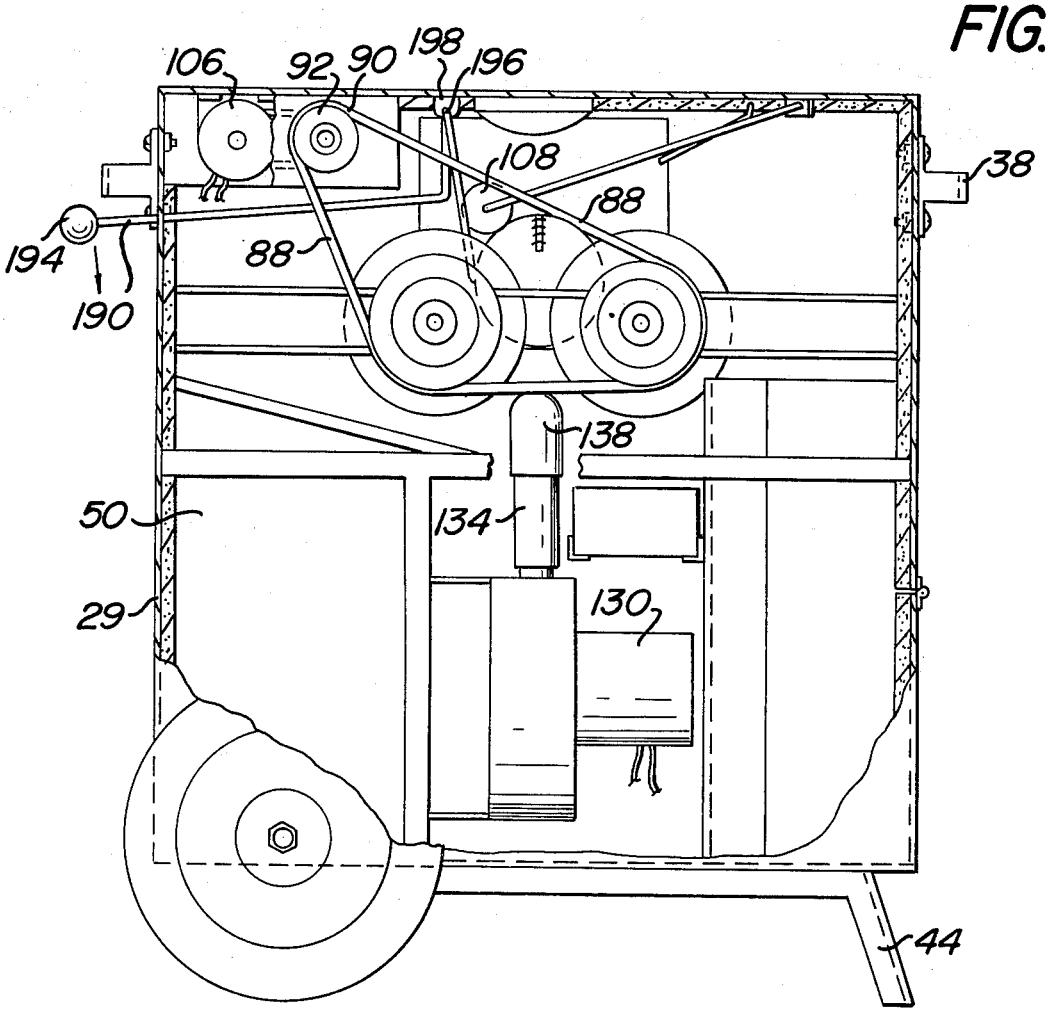
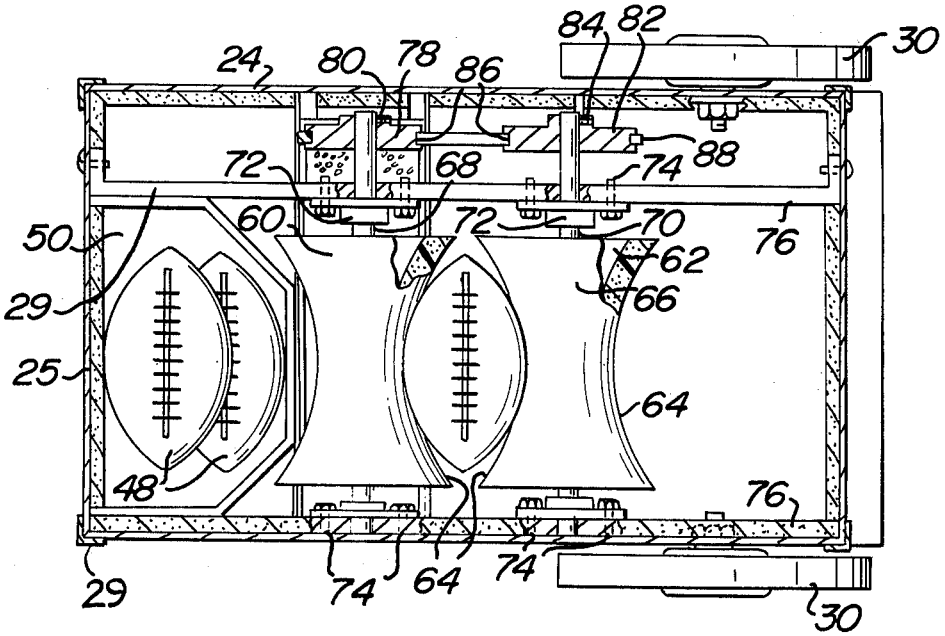
FIG. 4

PORTABLE FOOTBALL DRYER

This invention relates generally to portable dryers for rapidly and effectively wiping and drying wet footballs.

Due to the fact that footballs frequently get wet during use various drying apparatus have been proposed in the patent literature as a substitute for hand drying with a towel. However, such prior art football drying apparatus have been characterized as being not very effective, or if effective, impractical due to their inherent slowness of operation. Accordingly, the need exists for mechanical drying apparatus for footballs which can operate quickly and efficiently thereby enabling its exclusive use under game conditions and in all kinds of wet weather.

Examples of prior art drying and/or cleaning apparatus are as follows:

In U.S. Pat. No. 3,012,334 (Davis, Jr.) there is disclosed a portable football dryer having a drying chamber therein. A pair of rollers are disposed horizontally in side-by-side relation to each other within the chamber and include peripheral surfaces which are semi-elliptical and concave in shape. Another roller of a similar shape is disposed over the pair of side-by-side rollers. The football to be dried is placed between the rollers which are all driven at the same speed by a motor. The rollers include spiral grooves in their peripheral surfaces ostensibly for removing moisture from the football and discharging it from the ends of the groove in the form of a mist. Air is introduced into the housing by a blower to remove the mist. In addition, a pair of resistance heaters are provided to heat the air before it contacts the football. The moisture laden air is then exhausted to the ambient atmosphere.

In U.S. Pat. No. 3,078,591 (Carpenter) another portable football dryer is disclosed. The dryer of the Carpenter patent includes a housing having a bowl-shaped, football-receiving section including inwardly concave side walls having inwardly and upwardly convex lower portions. The section is arranged for receiving and guiding a football placed therein. A concave contoured cleaning brush is disposed within the bowl at the base thereof. The brush is adapted to be rotated about its longitudinal axis by motor means. The bowl and the brush cooperate so that a football disposed within the bowl is partially supported on the walls of the bowl and on the bristles of the brush. The rapid rotation of the brush is stated to effect the rapid rotation of the ball to provide a cleaning or abrasive action on the surface thereof. An infrared lamp is provided to direct heat rays into the interior of the bowl. Further heating and drying is provided by means of a fan.

Another type ball dryer is disclosed in U.S. Pat. No. 3,152,875 (Davis, Jr. et al). The Davis et al. patent discloses a housing including a pair of ball-supporting arcuate arms. The arms are pivotable with respect to one another and are arranged to grasp the ends of the football in a pincer-like manner to hold the football in the middle of a ball receiving chamber. A motor means is provided to rotate the arms about an axis perpendicular to the longitudinal axis of the football. Heating means is provided to heat the air for supply to the ball receiving chamber. The rotation of the ball is stated to act as an impeller to draw the heated air into the chamber for effectuating the removal of moisture from the ball. Furthermore, the rotation of the football is said to create a centrifugal force to further effect the removal of moisture from the surface of the ball. The moisture laden air is then passed to the outside atmosphere.

In U.S. Pat. No. Re. 25,462 (McCormick) there is disclosed apparatus for cleaning footballs. The apparatus includes a housing in which a plurality of concave guide or brush rollers are rotatably mounted for cradling support of the football to be cleaned. A driven concave guide or brush roller is arranged to contact the ball to rotate it about its major axis. Electric heating means and a fan are provided to circulate heated air around the ball as it is rotated and brushed.

As noted heretofore each of the above identified prior art devices suffer from one or more drawbacks and at present no device has been suggested in the literature or is commercially available for effecting the drying of wet footballs on a viable basis under in-game conditions.

Accordingly, it is a general object of the instant invention to provide apparatus which overcomes the disadvantages of the prior art.

It is a further object of this invention to provide a portable apparatus for effecting the quick and efficient drying of wet footballs.

It is still a further object of this invention to provide apparatus which is simple in construction and which is efficient in operation for effectively drying footballs on a rapid basis.

It is yet a further object of this invention to provide apparatus for drying wet footballs and for storing a plurality of dried footballs therein.

These and other objects of this invention are achieved by providing apparatus for drying a wet football comprising a housing having a drying chamber for receipt of a web football and having first and second rollers disposed therein. Each of the rollers include a concave, peripheral moisture-absorbing surface. The rollers are disposed parallel to each other and are spaced by a sufficient distance such that a wet football can be placed within the space therebetween and supported by the rollers. The rollers are rotated in the same direction by rotation means, with the first roller being rotated at a different speed than the second roller is rotated. The frictional engagement between one of the rollers and the ball causes the ball to rotate at a different speed than the speed of rotation of the other roller. This effects a rubbing action between the football and the other roller, whereupon the surface of the football is wiped clean and relatively dry. Means are provided for causing dried air to flow into the drying chamber and at the rotating football to further effectuate the drying of the ball. Dessicating means are provided for drying the air and recirculating means are provided for carrying the air from the drying chamber to the dessicating means.

Other objects and many of the attendant advantages of this invention will be readily appreciated as the same becomes better understood by reference to the following detailed description when considered in connection with the accompanying drawings wherein:

FIG. 1 is a perspective view of a portable football drying apparatus in accordance with the present invention;

FIG. 2 is an enlarged sectional view taken along line 2—2 of FIG. 1;

FIG. 3 is a side elevational view, partially in section, of the apparatus shown in FIG. 1;

FIG. 4 is a sectional view taken along line 4—4 of FIG. 2; and

FIG. 5 is a perspective view of a portion of the apparatus shown in FIG. 1.

Referring now to the various figures of the drawing wherein like reference characters refer to like parts, there is shown in FIG. 1 an improved football drying apparatus 20. The apparatus 20 is complete self-contained and self-powered so as to be portable for movement to any site on a football field for use in drying wet footballs and for storing the dried footballs for reuse.

As can be seen in FIG. 1, apparatus 20 comprises a housing 22 having a pair of opposed side walls 24, a pair of opposed end walls 25, a top wall 26 and a botton wall 28 (FIG. 2) mounted on a frame 29 formed of angle stock. As noted above, the device 20 is a portable unit and is adapted to be moved to various locations such as along the sideline area of a football field. To that end, apparatus 20 includes a pair of wheels 30 for facilitating the movement of the device. A pair of doors 32 and 34 are provided on opposed end walls 25 of the housing 22 adjacent the bottom wall 28 to provide access to respective interior portions, to be described later. Each of the doors is pivotably connected to its associated end wall by a horizontally disposed hinge 36. A handlebar 38 is secured to each of the end walls adjacent to the top wall 26 by a plurality of screws 40. The handlebars enable the apparatus to be pushed to its desired location.

As can be seen in FIGS. 1, 2 and 4, the housing 22 is mounted on a generally U-shaped base 42 formed of angle stock and terminating in a pair of downwardly extending fixed legs 44. The legs serve as rests upon which the device 22 is supported when it is ready for use or storage.

As can be seen in FIG. 2, the housing 22 basically comprises a pair of compartments or chambers, namely chamber 46, into which the wet football 48 is inserted for drying therein and compartment 50 wherein plural footballs heretofore dried in the drying chamber are stored for reuse.

As can be seen in FIG. 1, a door 52 is provided in one side wall 24 of the housing adjacent to the top wall 26. The door 52 is mounted on a hinge 54 and is adapted to close an opening 56 in the housing. The opening 56 serves as the passageway into the drying chamber 46 and through which a wet football is inserted for drying. As can be seen in FIG. 2, door 34 communicates with the storage chamber 50 to provide access to the interior thereof so as to enable dried footballs to be removed therefrom. The door 32 communicates with a compartment in which power means, to be described in detail later, is disposed to provide ready access thereto.

The drying chamber 46 and the storage chamber 50 are insulated from the ambient atmosphere surrounding the apparatus 20 since such atmosphere may be extremely cold and wet. To that end, as can be seen, a thermally insulative lining 58, such as one-half inch thick foam, is provided all over the interior surface of the side walls, end walls, top walls and bottom wall forming the chambers 46 and 50.

In accordance with one aspect of this invention mechanical means are provided within drying chamber 46 for physically wiping the surface of a wet football placed therein. Such means comprise a pair of support rollers 60 and 62. Each support roller is an elongated member having a concave peripheral surface 64 (FIG. 4). In the embodiment of the invention shown in the drawing each roller is formed of a highly moisture absorbent material, such as foam rubber, and includes an aluminum tube 65 extending longitudinally down the central axis of the roller. It should be pointed out at this juncture that various other types of roller construction are contemplated within the scope of this invention providing that the peripheral surface thereof is capable of absorbing moisture.

Each roller 60 and 62 is arranged to be rotated about its longitudinal axis. To that end, the aluminum core 65 of roller 60 is fixedly secured by means, not shown, to a rotary shaft 68 and the aluminum core of roller 62 is fixedly secured by means, not shown, onto a rotary shaft 70. The ends of the shafts 68 and 70 are supported within bearings 72. The bearings are in turn mounted, via screws 74, on a pair of horizontal support bars 76 forming a portion of frame 29.

In order to rotate the shafts 68 and 70 and hence rollers 60 and 62, respectively, each shaft has secured therein a drive pulley. To that end, as can be seen in FIGS. 2, 3 and 4, a pulley 78 is fixedly secured, via a set screw 80, to the free end of shaft 68. In a similar manner a pulley 82 is fixedly secured, via a set screw 84, to the free end of shaft 70. Each pulley includes a peripheral race 86 in which a drive belt 88 is disposed. The drive belt 88 is also received within a race 90 (FIG. 3) in a drive pulley 92. Drive pulley 92 is mounted on a horizontal shaft 94 within housing 22 and closely adjacent the top wall thereof. Also mounted on shaft 94 is another pulley 96 having a peripheral race in which a smaller drive belt 98 is disposed. The smaller drive belt also extends within a race 100 in a motor pulley 102 mounted on a shaft 104. The shaft 104 constitutes the output drive shaft of an electrical motor 106 (FIG. 3).

It should thus be appreciated that operation of the motor 106 rotates drive shaft 104 causing the rotation of shaft 94, via the smaller drive belt 98, and pulley 96. The rotation of shaft 94 is coupled, via pulley 92 and drive belt 88, to the pulleys 78 and 82. The rotation of pulley 78 effects the rotation of the roller 60, via its shaft 68, while the rotation of pulley 88 effects the rotation of the roller 62, via its shaft 70, and in the same direction as roller 60.

In accordance with one of the preferred aspects of the instant invention the support rollers 60 and 62 are of identical size. Each of the pulleys 78 and 82 is a different size, whereupon when the rollers 60 and 62 are rotated by the those pulleys the rollers rotate at different peripheral speeds. In the embodiment shown herein pulley 78 is of a slightly larger diameter (3½ inches) than pulley 82 (3 inches), whereupon roller 60 rotates at a higher peripheral speed than roller 62.

It should be appreciated by those skilled in the art than when a ball is disposed within the space between rollers 60 and 62 and supported in that space by contact with said rollers, frictional engagement occurs between at least one of the rollers and the ball. The rotation of the frictionally engaged roller causes the ball to rotate about its longitudinal axis at a differet speed than the speed of rotation of the other roller. This action creates a rubbing effect between the ball and the other rotating roller, thereby wiping the moisture off the surface of the football 48. In practice it has been found that some rubbing occurs between each of the rollers 60 and 62 and the ball, thereby indicating that the ball is rotated by the action of both of the rollers 60 and 62 at some intermediate speed, that is a speed between the speed of rotation of roller 60 and the speed of rotation of roller 62.

It should also be pointed out that in addition to wiping the ball dry, the rollers also aid in wiping the ball clean of mud or other foreign material during the rubbing action.

In order to prevent the ball 48 from bouncing around during the wiping action, thereby detracting from the moisture removal process, a pressure applying or stabilizing roller 108 is provided. The stabilizing roller is operative to apply a downward stabilizing force onto the football 48 to hold the football nested in place between the concave peripheral surfaces of the rollers 60 and 62. This action ensures that good frictional engagement is made between the ball and the rollers to improve the rubbing action, thereby hastening the drying of the football.

To that end, as can be seen in FIGS. 2 and 5, stabilizing roller 108 is mounted on a pivoting arm 110 at a normally extending free end portion 112. The arm 110 is arranged to be pivoted about a horizontal axis to move the roller 108 towards and away from support rollers 60 and 62. To that end, arm 110 includes an intermediate portion 114 extending in the same direction as portion 112. Portion 114 serves as the axis about which the arm is pivoted. As can be seen in FIGS. 2 and 5, portion 114 extends through a pair of aligned openings 116 in a pair of brackets 118. The brackets 118 are mounted on the inside surface of the top wall 26 of the housing and extend normally downward therefrom.

The pivotability of roller 108 as described above serves to enable the roller to be moved to a retracted position towards the top of the housing and out of the way from the space between rollers 60 and 62 so that a wet football can be readily inserted into the space between those rollers. In accordance with a preferred aspect of this invention coupling means are provided to automatically pivot the stabilizing roller to the retracted position whenever the door 52 to the housing is opened. Once the football is in position and the door 52 closed, the stabilizing roller 108 is automatically pivoted downward to the biased position shown in FIG. 2 such that the drying of the football can commence.

The automatic coupling means is shown clearly in FIG. 5 and comprises an actuating lever 120 projecting normally from the end of pivoting arm portion 114 and opposite to portion 110. The actuating level 120 extends upward (in a counter clockwise direction) at an acute angle to the longitudinal axis of arm portion 110. An actuator 122 is securely mounted to the inside surface of door 52, via plural screws 124. The actuator 122 includes a horizontally extending rod portion 126 terminating in a free end portion 128 extending upwardly at an acute angle to the axis of the horizontal portion. The portion 128 is adapted to contact actuator arm 120 when door 52 is pivoted open to cause arm 120 to slide up the portion 128, thereby pivoting the actuator arm 12 upward (in the counter clockwise direction) as seen in FIG. 2. This action results in the concomitant rotation of arm 110 about the axis formed by portion 114 which in turn moves the roller 108 upward through an arc to the retracted position, that is, towards the inside surface of the top wall of the housing and away from the support rollers 60 and 62. The ball can then be readily positioned between the support rollers. When the door 52 to the housing is closed the actuator arm 120 slides down free end portion 128, thereby rotating downward (in the clockwise direction) shown in FIG. 5 which thereby causes arm 110 to rotate in the same direction, whereupon roller 108 is pivoted to the biased position shown in FIG. 2. In the biased position the roller makes contact with the surface of a football to apply pressure to it and hold it in place within the space between rollers 60 and 62.

The roller is mounted for free rotation on portion 112 of the pivoting arm to enable it to ride in place on the ball to apply pressure to the ball during its rotation on rollers 60 and 62.

In order to further effectuate the drying of the football, means to be described in detail hereinafter, are provided to direct dry air at the football as it is rotated and wiped by rollers 60 and 62. To that end, as can be seen in FIGS. 2 and 3, a blower 130 is mounted within a compartment 132 in housing 22. The compartment 132 is disposed below the drying chamber 46 and beside the ball receiving chamber 50.

The blower includes an outlet port coupled to an air conduit 134. Conduit 134 extends upward from the blower 130 through an opening in the insulation 58 separating the compartment 132 from the drying chamber 46 and communicates with an air distributor or duct 136. The duct 136 is in the form of a hollow tube which extends horizontally within the drying chamber and immediately below the space between the two rollers 60 and 62. While it can not be seen from the drawing, duct 136 extends parallel to the axes of the rollers 60 and 62 and is at least as long as the major dimension of a regulation football. A plurality of air ports 140 (FIG. 2) are provided in the top portion of duct 136, that is the portion closest to the space between rollers 60 and 62 and into which a ball to be wiped is placed. The ports 140 serve to direct dried air to a wet football disposed within the space between the rollers as the rollers effect the wiping of the same. The dry air serves to further dry the football by causing any moisture remaining on the surface thereof and not absorbed by the rollers 60 and 62 to be evaporated. The openings 140 also serve to direct dry air at portions of the rollers contiguous with the football. This action serves to remove moisture picked up by the rollers during the wiping operation.

In accordance with a preferred aspect of this invetion the air used to dry the football is continually recirculated and redried. This results in a very efficient dryer since it is not dependent upon the existence of dry air in the ambient atmosphere.

As can be seen clearly in FIG. 2, a tray 142 containing a dessicating agent such as silica gel 144 is mounted on a track 146 on a wall 148 separating chamber 50 from compartment 132. An opening 150 is provided in the insulation 58 separating drying chamber 46 from compartment 132 and immediately over the silica gel holding tray 142. A porous screen 152 is disposed within opening 150.

Operation of the air circulating and drying means is as follows: Dry air is forced by the blower in the direction of the arrows identified by the reference numeral 160 through conduit 134, duct 136 and out through ports 140 to result in the evaporation of the moisture on the surface of the football as the ball is wiped by rollers 60 and 62. The air which picks up the moisture from the football then flows, in the direction of the arrows 162, through screen 152 and into the silica gel 144 where the moisture is removed. The dry air then flows downward as shown in FIG. 2 to the bottom of the housing and across the bottom of the housing in the direction of the arrow 164. The dry air then enters an inlet port 166 in the blower for recirculation.

In accordance with one aspect of this invention a small portion of the air forced into the drying chamber flows over the wall 148 in the direction of arrow 168 and into the ball receiving chamber 50. This air then flows out through small openings 170 in the wall 148 and joins up with the dry air denoted by the arrows 164 for recirculation by blower 130. Accordingly, those footballs 48 stored within chamber 50 are maintained in a dry condition by the circulating air.

In order to facilitate the replacement of the silica gel the drawer 142 is arranged to be slid out from its track 146 and through the side wall 24. To that end, a pivotable door 172 is provided in side wall 24 immediately adjacent to drawer 142.

In accordance with another aspect of this invention gentle heat applying means are provided to help dry the valleys between the pebble grains on the surface of the football that are not reached by the rubbing action of the rollers.

It should be pointed out at this juncture that the application of too much heat to the football during the drying operation may result in the distortion of the shape of the ball due to pressure changes within the ball. In this connection it is believed that the ball should not be exposed to temperatures higher than those existing if the ball was sitting in the sun on a hot day, e.g., 120° F. On cold days, because of the pressure change, the maximum temperature would have to be substantially less than 120° F., to maintain a reasonable temperature differential between the ball on the field and one that has been brought through the dryer. In accordance with a preferred embodiment of the invention the gentle heat applying system comprises a radiant heater in the form of a sealed-beam spot lamp 174. The spot lamp 174 is mounted on the inside surface of the top wall 26 of the housing and is aimed to scan the entire surface of the ball as it rotates, thereby warming the valleys and seams of the ball. This action reinforces the action of the dried air on areas of the ball that the rollers do not reach.

Electrical power for the motor 106, the blower 130 and the radiant heating means 174 is provided via a storage battery 176 disposed within a compartment 178 and separated from compartment 132 by wall 180. Access to the interior of compartment 178 is provided via the pivotable door 32.

The electrical circuitry connecting the storage battery to the motor, blower and radiant heating means is not shown in the interests of drawing simplicity. However, such means includes various switches 182 to control the separate functions of the apparatus 20. For example, a switch 182 is provided to enable the blower motor to be operated at a reduced voltage so as to run it at a lower speed and thereby conserve battery power. Such operation is desirable during time periods when the device is not operating to dry a wet football. The low speed operation enables the blower motor to nevertheless circulate dry air through the compartment to dry the rollers while conserving battery power. Another switch 82 enables the motor 106 to be operated at a reduced voltage and hence at a lower speed such that the drying rollers operate at a lower rotational speed for some applications. When a football is to be dried quickly full voltage is provided to both the blower and roller motors. This provides maximum air flow and rubbing action for optimum drying. Other switches are also provided, such as a switch 182 for the radiant heating means, etc. The switches 182 are mounted on a control panel 184 disposed in the side wall 24 adjacent to door 52 for easy accessibility. Meters 186 are also provided in the control panel 184 to monitor various electrical functions of the apparatus.

As can be seen in FIGS. 1, 2 and 3, ejection means are provided for removing the ball from its nested position between rollers 60 and 62 and into the dry ball storage chamber 50 once drying is completed. The ejection means is denoted by the reference numeral 188 and comprises an actuating lever 190 extending through slot 192 in end wall 25 and terminating at its free end in a handle 194. The end of lever 190 disposed opposite to handle 194 extends upward and merges into a horizontal portion 196 extending through an opening 198 in a bracket 200 mounted on the inside surface of the top wall 26. The portion 196 forms a pivot axis for the ejection means 188. An ejection arm 202 extends normally to the longitudinal axis of portion 196 and downward to a position closely adjacent to the space betwee rollers 60 and 62 in which a wet ball is received. The ejection arm 202 terminates in a ball contactor 204 which extends normally to arm 202 and parallel to the longitudinal axis of the football 48.

Operation of the ejection means 188 is as follows: When handle 194 is grasped in the user's hand and pivoted downward the resulting rotation of arm 190 (in the clockwise direction as shown in FIG. 2) results in the concomitant rotation of the ejector arm 202, whereupon ball contacting portion 204 hits the surface of the football 48 held within rollers 60 and 62 to lift the ball upward towards roller 60 and away from roller 62. The frictional engagement between the rotating roller 60 and the ball serves to pull the ball upward over the roller 60 in the direction of the arrows 206 and into the ball receiving chamber 50.

A typical complete operational cycle of apparatus 20 is as follows: Door 52 is opened, whereupon arm 122 causes the upward pivoting of stabilizing roller 108, thereby providing ready access to the drying chamber 46 and to the space between rollers 60 and 62 for receipt of the wet ball. The ball is then placed in the space between the rollers and the door 52 closed, whereupon stabilizing roller 108 pivots downward to the position shown in FIG. 2 and provides a downward biasing force to hold the football securely in its nested position. Assuming that the blower motor has been operating heretofore at a lower speed to effect the drying of the rollers 60 and 62, via the circulation of the air, the speed of the blower motor is increased and the roller motor 106 turned on. The ball is then rapidly wiped by the rotating sponge rubber rollers 60 and 62 and the dry air directed at it under the influence of the gentle warming rays from the lamp 174. The centrifugal force created by the rotation of the roller helps separate droplets of moisture and forgein material from the surface of the ball, thereby further aiding in the cleaning and drying of the ball. After a short time (e.g., a half-minute) the ball is clean and dry and handle 194 of the ejector 188 is pushed downward causing the ball contacting portion 204 of the ejector to lift the ball of of roller 62, whereupon the ball is carried over roller 60 and into the dry storage chamber 50.

Assuming that no other ball is to be dried immediately thereafter, the switches 182 of the control panel are moved to their respective positions to shut off power to the roller motor 106 while providing a reduced voltage to the motor of blower 130. Accordingly, air continues to be circulated throughout the apparatus 20, albeit at a lower rate, to effect the drying of the sponge rollers 60 and 62. In addition, the recirculation of the air through the dessicating agent in tray 142 effects the drying of the air.

When it is desired to take a football from the apparatus 20 door 34 is pivoted open to provide access to the interior of chamber 50 and the dry balls disposed therein.

It should be appreciated from the foregoing that the apparatus of the instant invention offers various advantages over the prior art. Firstly, the moisture absorbent rollers which are rotated at different speeds create an effective rubbing or wiping action on the ball to transfer moisture from the ball to the rollers. In addition, the rubbing action also removes foreign material, such as mud, from the surface of the ball, thereby cleaning the ball as well as drying it. The rotation of the ball about its axis creates centrifugal force which helps separate droplets of moisture and foreign material from the surface of the ball.

Secondly, the dried air blown against the ball and the sponge rubber rollers further effectuates the drying action. The dessicating agent's affinity for moisture removes moisture from the circulating air, thereby reducing the relative humidity of the air. Except when the door is opened to insert or remove a ball the same air is recycled throughout the system and is constantly redried. Even when the ball is not on the rollers the air is constantly circulated to dry the rollers and the interior of the machine, thereby making it ready to quickly dry the next wet ball.

Thirdly, gentle radiant heat is provided for removing residual moisture from the valleys in the surface of the football, while not exposing the football to undue and potentially distorting heat.

The continual recycling of the air through the dessicating agent and back into the drying chamber of the apparatus of the instant invention provides the advantage of maintaining a much lower relative humidity in the drying chamber to decrease ball drying time with a minimum of energy expended. In regard to the latter it should be appreciated that with the recycling and redrying of the air by the apparatus of the instant invention virtually only the moisture removed from the ball has to be removed from the air since wet outside air is not continually taken into the housing. This is to be contrasted with prior art open-cycle appartus wherein moisture-laden outside air is continually drawn into the apparatus during the drying function. Accordingly, in prior art devices the moisture in the incoming air as well as the moisture absorbed from the ball has to be removed, which necessitates expending considerably more energy for effectively drying the wet ball.

Another feature of the apparatus of the instant invention which renders it particularly suitable for in-game use is the positioning of the wet ball entrance to the side of the housing and not in the top. As should be appreciated a top opening would allow rainfall to enter the drying compartment unless the apparatus is disposed under a shelter.

The feature of the thermally insulated chambers within the apparatus 20 is important in order to conserve battery power since the apparatus is self-contained and portable.

Without further elaboration, the foregoing will so fully illustrate my invention that others may, by applying current or future knowledge, readily adapt the same for use under various conditions of service.

What is claimed as the invention is:

1. Apparatus for drying a wet football comprising a housing having a storage chamber for holding dried footballs therein, a drying chamber for receipt of a wet football, said drying chamber having a door to provide access to its interior and including a pair of drying rollers, a stabilizing roller and ejection means disposed within said drying chamber, each of said drying rollers having a concave, peripheral, moisture absorbing surface, said drying rollers being disposed parallel to each other and spaced by a sufficient distance such that a football can be placed within the space therebetween and and supported by said rollers, said stabilizing roller being disposed over said drying rollers and being pivotable from a retracted position enabling the football to be inserted within the space between the drying rollers when said door is open to a biased position to hold the football in said space when said door is closed, said rollers being rotated in the same direction by rotation means, with one of said drying rollers being rotated at a different speed than the other of said drying rollers, whereupon the frictional engagement between one of said drying rollers and the ball causes the ball to rotate at a different speed than the speed of rotation of the other of said drying rollers to effect a rubbing action between the ball and the other of said drying rollers, thereby wiping the surface of said ball, said ejection serving to remove the football from the space between said drying rollers after it has dried and for causing the dried football to be inserted into the storage means.

2. The apparatus of claim 1 including first means for causing dried air to flow into said drying chamber whereupon said wiped ball is dried.

3. The apparatus of claim 2 additionally comprising dessicating means for drying air and recirculating means for carrying air from said drying chamber to said dessicating means.

4. The apparatus of claim 3 wherein said first means directs said air at said football as it is rotated.

5. The apparatus of claim 4 wherein said chamber is sealed and includes a side opening through which said ball is inserted for drying.

6. The apparatus of claim 5 including blower means for forcing dried air into said drying chamber.

7. The apparatus of claim 6 including gentle heating means disposed over the space between said rollers to aid in the drying of said ball as it is rotated by said rollers.

8. The apparatus of claimm 7 wherein said heating means comprises a sealed-beam spot lamp.

9. The apparatus of claim 8 including self-contained power means for rotating said rollers and operating said blower.

10. The apparatus of claim 9 wherein said power means comprises an electric storage battery.

11. The apparatus of claim 10 wherein said housing additionally comprises a storage chamber for holding dried balls therein.

12. The apparatus of claim 11 wherein said housing is mounted on wheels for enabling said apparatus to be rolled to desired locations.

* * * * *